United States Patent [19]

Anderson et al.

[11] Patent Number: 5,049,929

[45] Date of Patent: Sep. 17, 1991

[54] CONFLICT RESOLUTION WITH WARNING IN A REPROGRAPHIC SYSTEM

[75] Inventors: Karen K. Anderson; John W. Daughton; Robert L. Sklut; Keith G. Bunker, all of Rochester, N.Y.

[73] Assignee: Xerox Corporation, Stamford, Conn.

[21] Appl. No.: 446,517

[22] Filed: Dec. 5, 1989

[51] Int. Cl.[5] ..... G03G 15/00

[52] U.S. Cl. ..... 355/204; 355/313

[58] Field of Search ..... 355/200, 204, 313, 314; 364/518, 943

[56] References Cited

U.S. PATENT DOCUMENTS

| | | | |
|---|---|---|---|
| 4,090,787 | 5/1978 | Hubbard et al. | 355/314 |
| 4,521,847 | 6/1985 | Zeihm et al. | 364/184 |
| 4,615,610 | 10/1986 | Yoshiura | 355/210 |
| 4,814,824 | 3/1989 | Ito et al. | 355/313 X |

FOREIGN PATENT DOCUMENTS

| | | | |
|---|---|---|---|
| 59-53863 | 3/1984 | Japan | 355/313 |

*Primary Examiner*—Joan H. Pendegrass

*Attorney, Agent, or Firm*—Ronald F. Chapuran; Duane C. Basch

[57] ABSTRACT

A reproduction system which includes inter alia a user interface providing a means for programming a plurality of features associated with the execution of a copying job. The system includes a means for comparing the most recently selected feature with all previously programmed features in order to identify any mutually exclusive or undesirable feature pairs. Finally, the system also contains one or possibly multiple priority establishing methods or schemes for use in automatically resolving conflicting feature selections.

15 Claims, 7 Drawing Sheets

CONFLICT RESOLUTION WITH WARNING IN A REPROGRAPHIC SYSTEM

BACKGROUND OF THE INVENTION

1. Field of the Invention

This invention relates generally to the programming of system features for a xerographic reproduction machine and in particular to the resolution of conflicting feature selections entered by an operator.

2. Description of the Prior Art

It is generally known to override a selected feature in a reprographic machine by a subsequently selected alternate feature. For example, an operator selecting tray one to supply copy sheets for copying will automatically cause the cancellation of an earlier selection of tray 2. Another example is the selection of a copy quantity X to be produced, which would automatically override a previous selection of Y copies. It is also a generally known technique to provide a warning message to an operator, who, when using a programmable reprographic system selects a feature or function that is inconsistent with previously programmed features or functions. It is also commonly known that certain reprographic systems have the capability to detect machine abnormalities while running and automatically return to a predefined default condition. U.S. Pat. No. 4,615,610 to Yoshiura discloses an electrostatographic copying machine control system which not only suspends execution of a copy production run upon detection of a machine abnormality, but also restores the system to a predetermined default state by exiting the most current copying mode. As described at col. 6, lines 44–55, a set of sensors, poised along the face of an original document platform, senses the current state and orientation of an original, issues warning signals upon detection of an inconsistent copy feature selection, and automatically releases control from a one set-two copy mode to a one set-one copy mode to compensate for programming inconsistencies.

Yoshiura discloses a system which is capable of detecting an incorrect document state, the action of the system, when such an abnormality exists, comprises a warning message and the resetting of the copying mode to a default (one set-one copy) state. While this is a means of correcting for what is perceived as an operator programming error, the response is predetermined and limited to a single abnormality, the state of the document on the platen.

U.S. Pat. No. 4,090,787 to Hubbard et al. discloses an automatic mode control system for a multi-mode electrostatic copying machine which automatically reselects machine control parameters to satisfy a standard setting following a time-out period of dormancy.

Hubbard et al. focuses on means for the recovery from system abnormalities which require intermediate states. More specifically, the system is designed to assist a casual user in the recovery from a system abnormality such as a paper jam. However, Hubbard et al. does not disclose any means for detecting or correcting copy job programming errors prior to the start of such a job.

U.S. Pat. No. 4,521,847 to Ziehm et al. discloses an automatic job recovery control system for an electrostatic copying machine which permits job continuation by reinitializing various processors within a multiprocessor system upon detection of a machine malfunction.

The prior art is also directed towards the recovery from system errors subsequent to the occurrence of such an error. While there are requirements for error recovery capabilities within a reprographic system, there is an equally important need for systems which would identify and resolve mutually exclusive or conflicting programming selections within such a system. More importantly, a programmed feature conflict resolution system would facilitate the use, by a casual operator, of a complex reprographic system with many user selectable features. In addition, such a system would have a positive impact on operator efficiency by properly recognizing the operator's intentions and eliminating the need for the operator to manually deselect conflicting features which are no longer desired.

It is therefore an object of the present invention to recognize feature selections which are in conflict with previously programmed features, as opposed to an alternate selection that is merely an override of a previous selection. It is a further object of the invention to automatically resolve programming conflicts based on a predefined priority of feature selection. It is an additional object of this invention to increase operator efficiency by decreasing the number of operator steps required to correct or deselect a programming feature conflict. It is a final objective of the present invention to enable dynamic alteration of the conflict resolution priority based upon information stored within the system (i.e. paper sizes available in copy sheet trays, previous job types executed by an auditron account user, etc.).

Further advantages of the present invention will become apparent as the following description proceeds and the features characterizing the invention will be pointed out with particularity in the claims annexed to and forming a part of this specification.

SUMMARY OF THE INVENTION

Briefly, the present invention is a system for programming the features of a reprographic system in which the system is capable of determining when two or more mutually exclusive features have been selected. In addition, the system has the further capability to automatically deselect one or more of the conflicting features based on a predetermined level of importance or historical record of selection, such as preservation of the most recently selected feature. Such a system has an additional benefit in that the automatic deselection of a feature would eliminate the need for the operator to manually deselect the feature, thereby increasing an operator's efficiency.

BRIEF DESCRIPTION OF THE DRAWINGS

For a better understanding of the present invention, reference may be had to the accompanying drawings wherein the same reference numerals have been applied to like parts and wherein.

DESCRIPTION OF THE PREFERRED EMBODIMENT

Figure 1:
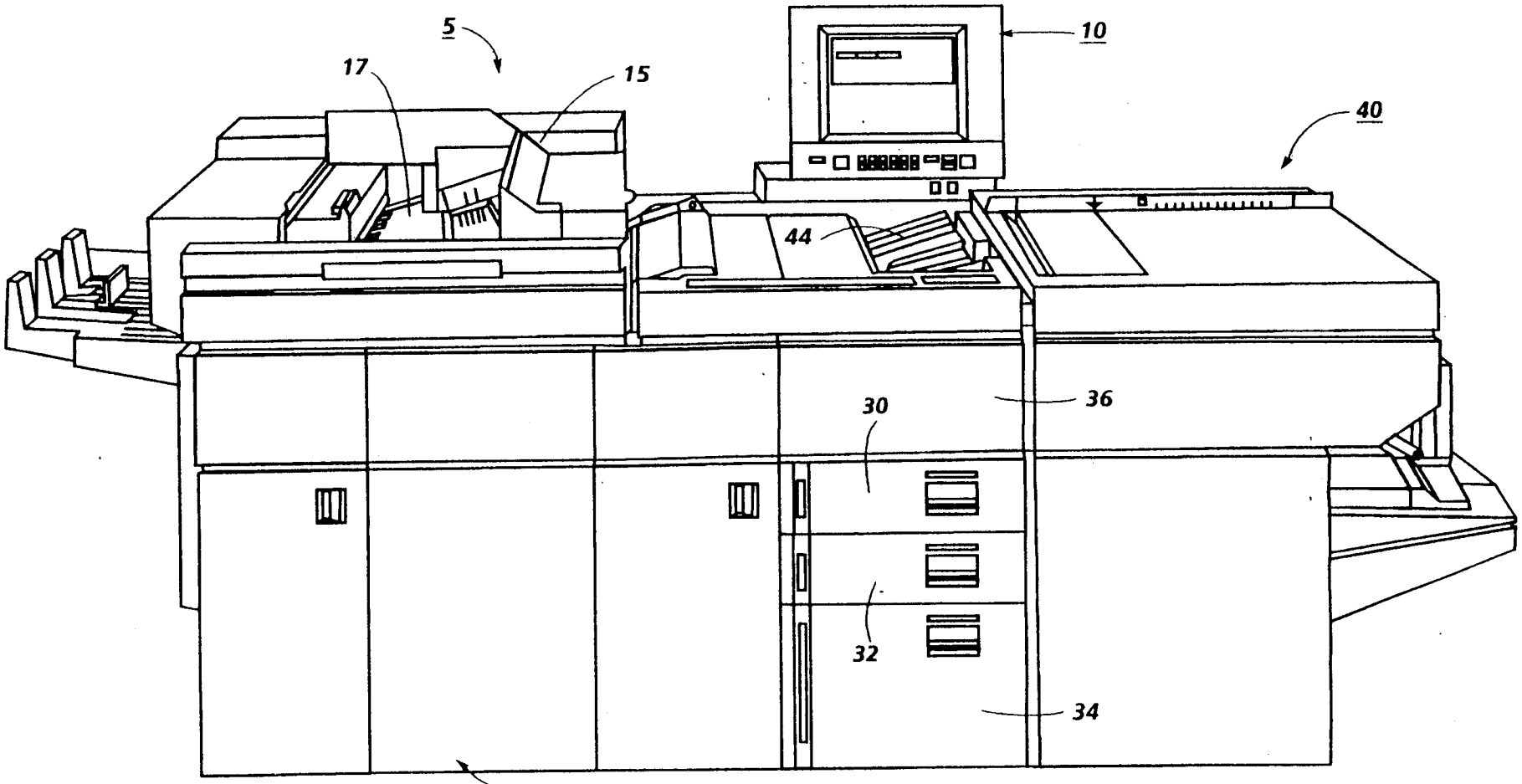
FIG. 1 is an isometric view of an illustrative xerographic reproduction machine incorporating the present invention.

For a general understanding of the features of the present invention, reference is made to the drawings. Referring to FIG. 1, there is shown a typical xerographic reproduction machine 5 composed of a plurality of programmable components and subsystems which cooperate to carry out the copying or printing job programmed through a user interface (U/I) 10.

A document handling unit 15 sequentially feeds documents from a stack of documents (not shown) in document tray 17 or optionally from a stack of computer forms, into an imaging position beneath document handling unit 15. After imaging, the documents are returned to document tray 17 via simplex or duplex copy paths (not shown) within document handling unit 15. Should the computer form feed (CFF) option be used, output of the computer forms would be to an output stacking tray on the side of the machine.

Imaging of the original documents occurs within the xerographic module 20, where the original document, on the platen, is exposed to create a latent image on a photoreceptor (not shown). Subsequently, the latent image is developed and transferred, within xerographic module 20, to a copy sheet which has been fed from one of the copy sheet trays 30, 32 or 34.

Following transfer, the image is permanently affixed to the copy sheet which is subsequently advanced to either finishing module 40, top output tray 44 or to a duplex storage module 36, for the first image on a duplex copy sheet. Options available within finishing module 40 are collation, stapling, and slip sheet insertion from copy sheet trays 30, 32 or 34.

The various functions and features within machine 5 are regulated by a system controller (not shown) which preferably comprises one or more programmable microprocessors. User programming and operating control over machine 5 are accomplished through U/I 10. Generally, operation and control information is stored in system memory (not shown) and accessed by the system controller when necessary. The system controller regulates the operation of the machine based on user programming of desired features, using the system status, as determined by conventional switches and sensors. The features within the machine are then regulated through the control of individual electrical and electromechanical devices, such as conventional servomotors, solenoids, etc.

Figure 2:
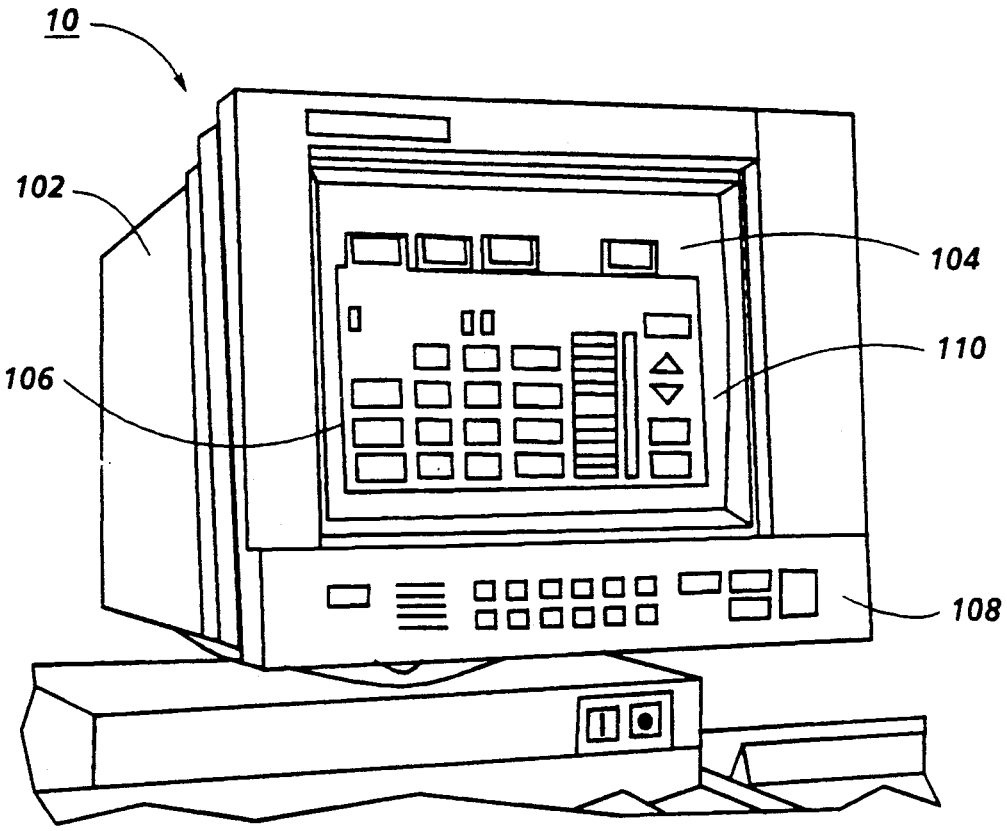
FIG. 2 is an isometric view of an illustrative user interface incorporated in the present invention.

Referring now to FIG. 2, where there is illustrated a detailed representation of U/I 10. The user interface is comprised of U/I housing 102, CRT display 104, Infrared (IR) touch sensor 106, and keyboard 108. Operator programming of the machine via the U/I is facilitated through display of programming screens 110 on CRT display 104 which represent programming features of the machine. Signals from IR touch sensor 106 are fed to the machine controller where they are interpreted with respect to the current programming screen. Subsequently operator selections are displayed on CRT display 104 and the appropriate machine subsystems are enabled, disabled or adjusted accordingly.

Figure 4:
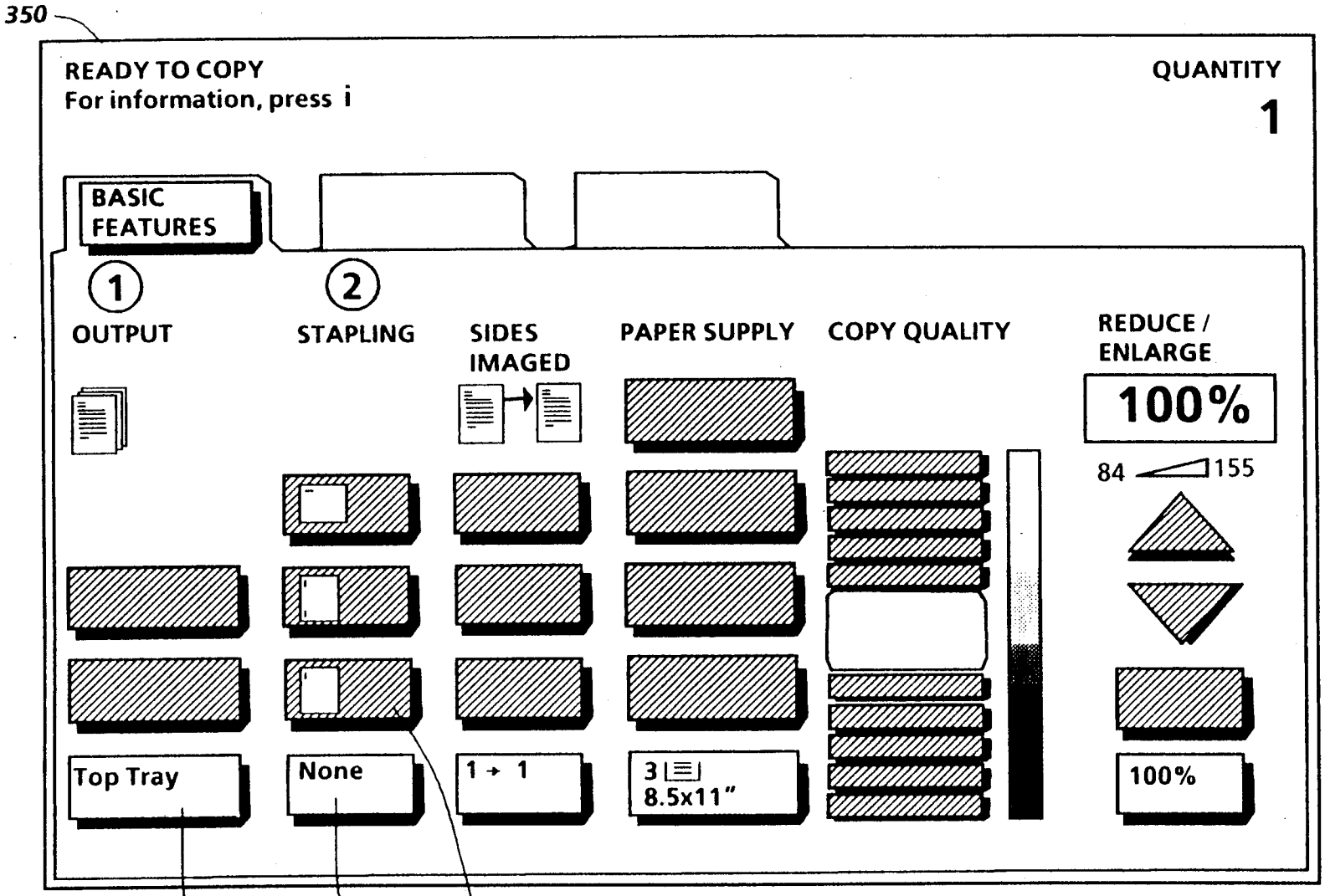
FIGS. 4 and 5 are examples of user interface screens associated with the operations illustrated in FIG. 3.

Programming screens 110, as displayed on CRT display 104, are used by the operator to select the feature set appropriate for the completion of a copying job. Specifically, the programming screens consist of a series of three primary screens, arranged in a file folder or tab format, as illustrated in FIG. 4. In certain instances, selection of specific programming features can only be done to the exclusion of other features due to machine constraints or known undersirable outcomes (i.e. stapling of transparency copy sheets). The currently programmed feature set is always displayed using programming screens 110, where selected features are indicated as highlighted or white buttons and disabled or deselected features are indicated with a grey background.

Figure 3:
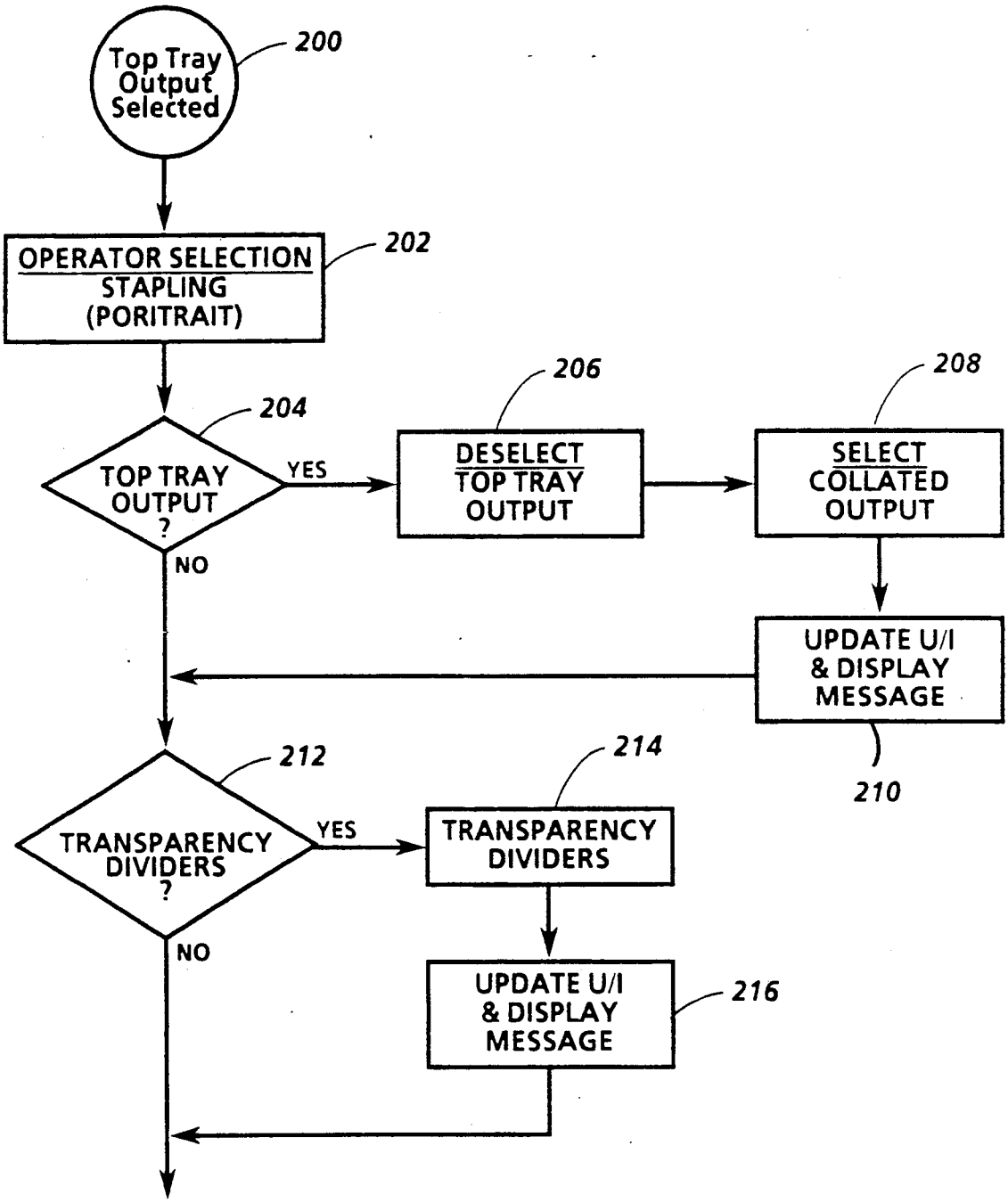
FIG. 3 is an example flowchart which depicts the operation of the present invention in testing for and resolving a feature conflict.

Referring now to FIG. 3, which illustrates a flowchart depicting an instance of operator selection of mutually exclusive features within the machine. In accordance with the present invention, the attempt to program or select mutually exclusive features will result in resolution of the programming conflict by the system controller, based on a predetermined decision scheme.

With respect to FIG. 3, the decision scheme illustrated is an example of a simple priority scheme designed to implement the most recently programmed feature to the exclusion of previously programmed conflicting features. This scheme is based on an assumption that the most recent feature selected by an operator most accurately reflects the operator's intent.

Initially, or possibly as the result of the previously completed copying job, the operator has selected output to be advanced to the top output tray, block 200. The programming screen at this point is shown in FIG. 4. Specifically, Top Tray output buttom 300 of FIG. 4 is highlighted to indicate the current output selection. In addition, the stapling feature is disabled, as indicated by the highlighted None button 302 of FIG. 4.

At a later time, the operator might wish to obtain stapled output and would select the Portrait Stapling feature, by touching the U/I screen in close proximity to the location of Portrait Stapling button 304 of FIG. 4. Activating IR touch sensor 106, by touching CRT display 104, would signal the selection to the system controller, which would in turn begin the procedure illustrated in FIG. 3, continuing at block 202. Subsequent to the determination that a selection has been made, the system controller tests to determine if the mutually exclusive Top Tray output feature is currently selected, block 204. If so, the system controller would then override the previously programmed information to enable the most recently selected feature of Portrait Stapling.

Figure 5:
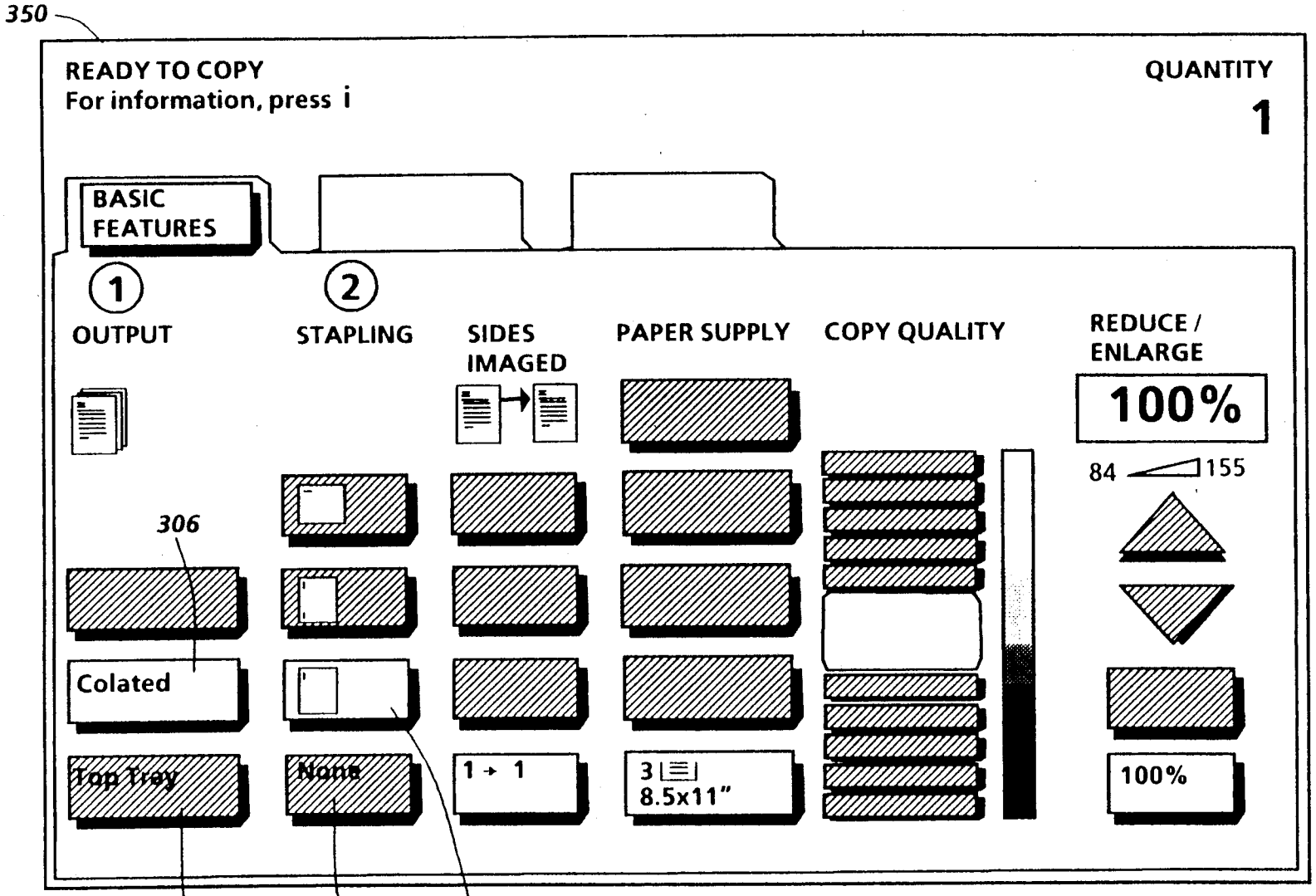

Based upon the "most recent selection" priority scheme, the controller would automatically deselect, or disable, the Top Tray output, block 206, and select Collated output, block 208. The CRT display 104 would also be updated, block 210, to reflect the changed feature set as indicated by FIG. 5, which depicts an updated programming screen 110. Referring specifically to FIG. 5, Top Tray output button 300 and None button 302 would be deselected, and Collated output button 306 and Portrait Stapling button 304 would now be selected or highlighted. In addition, a message would be displayed in area 350 of FIG. 4 to explain to the operator that an automatic feature deselection had occurred. Optionally, this message may be accompanied by an audible signal to the operator to alert him/her to the presence of a message.

Subsequent to determination of the status of the Top Tray output feature, the controller must also test to determine if the Transparency Dividers feature is currently enabled, block 212. The Transparency Dividers feature is used to include insert sheets between successive transparency copies to be used in a presentation, and in this situation, stapling is considered to be undesirable. If the Transparency Dividers feature was previously enabled, the feature will be automatically deselected by the controller as indicated in block 214. In addition, the Added Features programming screen will be updated, block 216, to reflect the deselection. When the stapling feature selection is made by an operator, the Added Features programming screen is not necessarily displayed. In this event, a message indicating that a feature has been automatically deselected is displayed in the area indicated by arrow 350 in FIG. 4.

A second example of two mutually exclusive features is the selection of the Auto Paper Select feature and the Auto R/E (Automatic Reduction/Enlargement) feature. The Auto Paper Select feature is used to enable the machine to sense the original document size, as fed by document handling unit 15 or as sensed by a document sensing shutter assembly (not shown) when placed manually on the platen. The system controller would then automatically select the correct copy sheet tray with the appropriate copy sheet size. The Auto R/E feature is intended to automatically sense the original document size in the same manner and determine the appropriate reduction/enlargement (R/E) percentage to fit the reproduced image on a selected copy sheet size.

Figure 6:
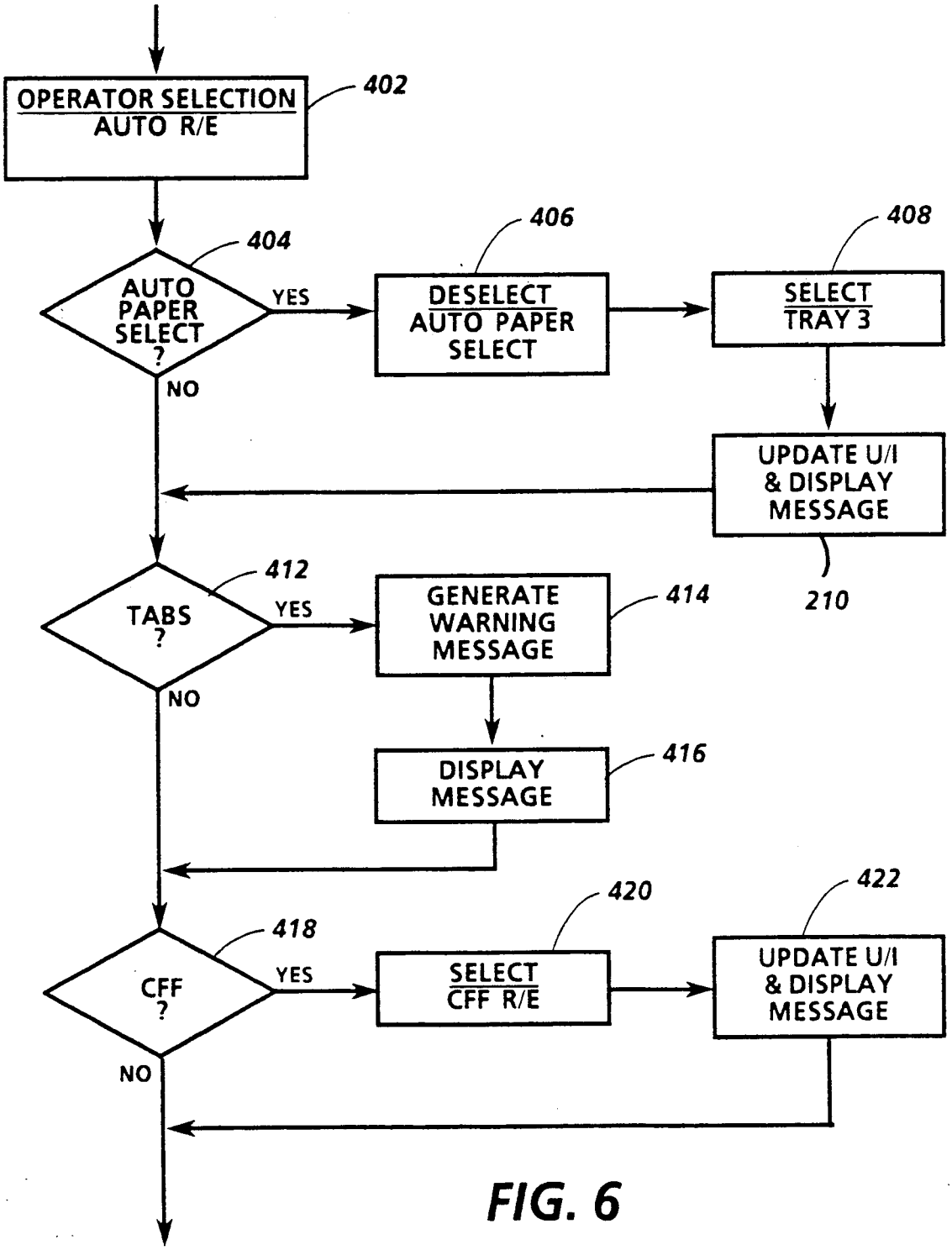
FIGS. 6 and 7 are flowcharts which depict two additional examples of the operation of the present invention in testing for and resolving feature conflicts.

For example, referring to FIG. 6, a feature conflict arises if an operator had first selected the Auto Paper Select feature and subsequently selected the Auto R/E feature, block 402. Detection of the previously selected Auto Paper Select feature is accomplished in block 404. Resolution of the conflict, according to the "most recent selection" decision scheme, results in the deselection of the Auto Paper Select feature at block 406, with the default copy sheet tray set to Tray 3, block 408. Subsequently, block 410 will serve to update the user interface and display a message indicative of the automatic deselection operations carried out by the system controller.

In this example, the default copy sheet tray has been established as Tray 3, block 408, because it is the largest capacity copy sheet tray. As an alternative, selection of the default copy sheet tray may be based on the frequency of use of different trays, as recorded by the system controller in system memory, thereby defaulting to the most frequently used copy sheet tray.

In addition to testing for the Auto Select feature, additional tests are subsequently carried out to determine the status of the Tabs and CFF features, block 412 and 414 respectively. The Tabs feature automatically shifts the copy image as placed on the copy sheet to accommodate tabs. The features are not mutually exclusive, however, undesirable results may be produced. Should the Tabs feature be selected a message suggesting production of a single sample or "proof" copy set will be generated in block 414 and displayed on the CRT display, block 416.

The Computer Forms Feed (CFF) feature is another conflicting feature when considered with respect to the Auto R/E feature. However, due to the known document size associated with standard computer forms or the calculated document size based on operator specification of the form length and width, a CFF reduction ratio can be automatically applied by the system, block 420, thereby eliminating the need for document size sensing.

A final example is one in which the Uncollated output feature and the Covers feature need not be mutually exclusive, but have been determined to be undesirable from an operator's perspective. Specifically, the example assumes that the Uncollated Output feature has been previously selected, and at a later time the operator selects the Covers feature. The Uncollated output feature provides multiple copy sets output in an uncollated fashion. The Covers feature provides the capability to add a cover sheet to a collated copy set, from a designated copy sheet tray, to individual document sets. Selection of both features is not allowed because output would be uncollated, and uncollated output of this nature has been determined to be undesirable and in addition, would be achievable using alternative feature selections.

Figure 7:
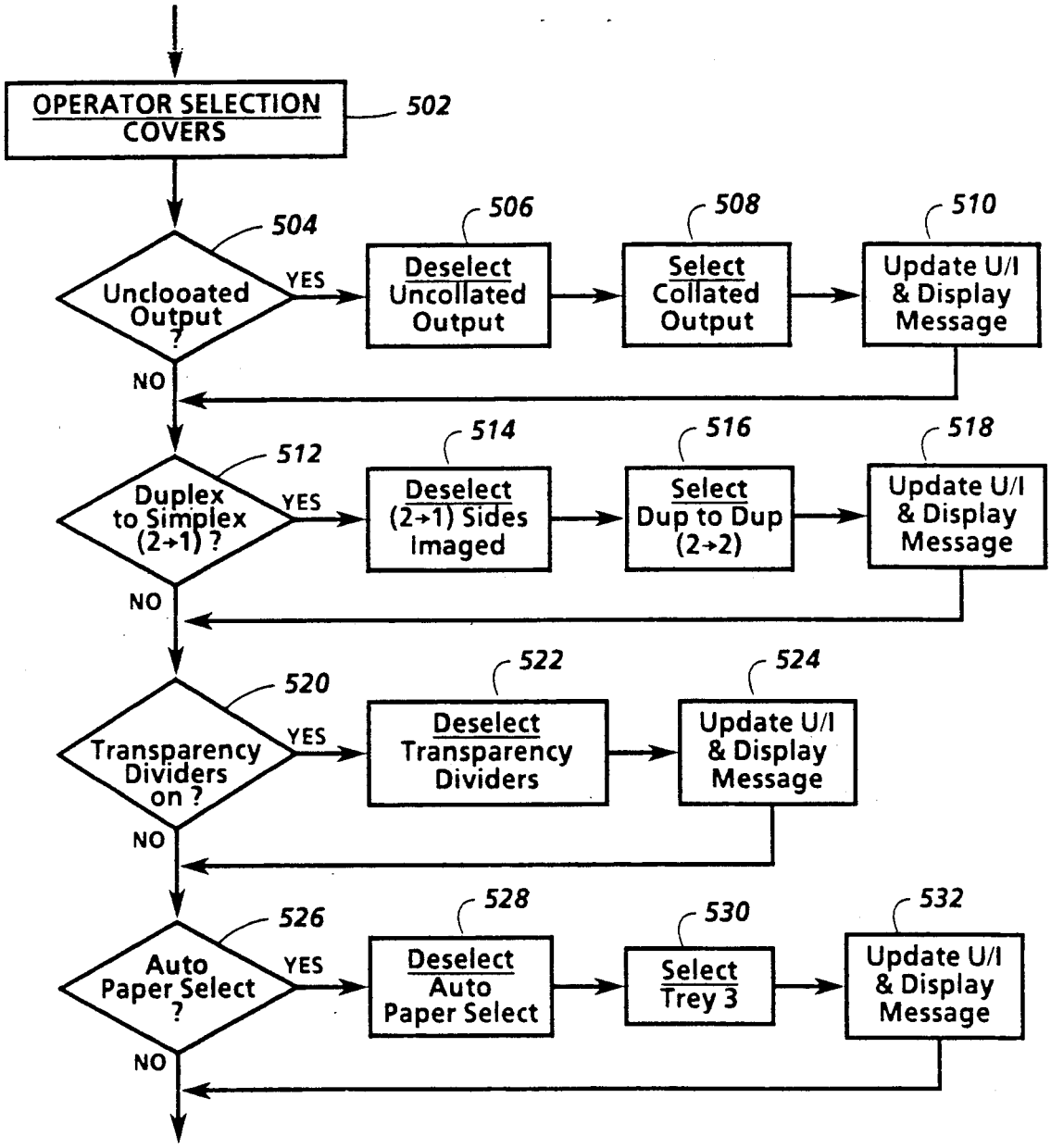

Referring now to FIG. 7, which depicts the decision process associated with this example based on a "most recently selected" decision scheme. In accordance with the present invention, upon operator selection of the Covers feature, block 502, the system controller first tests to determine if the Uncollated Output feature has been previously selected, block 504. If so, the system controller would deselect the Uncollated Output feature, block 506, and select the Collated Output feature, block 508. Finally, the system controller updates the user interface and displays a message for the operator to indicate the automatic resolution of the conflict, block 510.

Following the test for the Uncollated Output feature, block 504, additional testing is carried out for other potential feature conflicts. These tests include a Duplex To Simplex (2->1) feature, Transparency Dividers feature and Auto Paper Select feature, blocks 512, 520 and 526 respectively. In the same fashion as the previous examples, a positive response for any of these tests will result in the automatic resolution of the conflict by a subsequent deselection and/or selection process.

The decision scheme used to establish the priority between mutually exclusive or undesirable features has been illustrated in the previous examples in a form using the "most recent selection" criteria. However, alternative decision schemes may be incorporated in the same manner to resolve conflicting feature selections made by an operator.

As an example, an alternative decision scheme could be based on the frequency of use of a similar feature set. More specifically, when a feature conflict is detected, the machine might access a database of previously executed copying jobs to determine the frequency of occurrence of job programming feature sets containing the two mutually exclusive features. Upon determining the job programming feature set with the highest frequency of occurrence, the conflicting features would be appropriately selected and deselected to be consistent with the "most often used" feature set decision scheme. An extension of this decision scheme includes analysis of the "most often used" decision scheme to specifically reflect feature set frequencies associated with individual users or auditron accounts.

Selection of a specific decision scheme is subject to determination of whether the decision scheme fulfills the objective of increased operator efficiency. Further refinement of the conflict resolution process may be extended to include implementation of a plurality of decision schemes, each being selected for a different set of feature conflicts. In addition, further extensions would allow for service or operator selection of conflict decision schemes to enable customization to meet the needs of each machine installation.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. A reproduction system having
- a means for selecting a plurality of features associated with the execution of a copying job,
- a means for storing all of said previously selected features associated with a copying job in system memory,
- a means for comparing each subsequently selected feature, at the time of selection, to determine if a conflict exists with another feature,
- a means for reporting the existence of such a conflict to the system controller.
- a means for determining the higher priority of two conflicting features,
- a means for deselecting one of said conflicting features with the lowest priority, and
- a means for notifying the user that the conflict has been resolved, including an indication of the feature that was deselected.

2. A reproduction system having
- a user interface providing a means for programming a plurality of features associated with the execution of a copying job,
- a means for comparing the current feature selection with all previously programmed features to determine conflicting selections, and
- a means for automatically resolving said conflicting selections in accordance with a decision scheme.

3. The system of claim 2, including the means to alter the decision scheme.

4. The system of claim 2 wherein the means for comparing the most recently programmed with all previously programmed features to determine conflicting selections comprises:
- a means for storing all of said previously programmed features associated with a copying job in system memory,
- a means for comparing each subsequently programmed feature, at the time of selection, to determine if a conflict exists with another feature, and
- a means for reporting the existence of such a conflict to the system controller.

5. The system of claim 2 wherein the means for automatically resolving said conflicting selections comprises:
- a means for establishing the higher priority of two conflicting features,
- a means for deselecting the conflicting feature with the lowest priority, and
- a means for notifying the user that the conflict has been resolved, including an indication of the feature that was deselected.

6. The system of claim 5 wherein the means for establishing the higher priority of two conflicting features comprises:
- a means for determining the most recently selected of the two conflicting features, and
- a means for indicating that said most recently selected feature is of higher priority than a second conflict feature.

7. The system of claim 3 wherein the means for establishing the higher priority of two conflicting features comprises:
- a means for determining the most frequently selected of the two feature sets comprising said conflicting features, and
- a means for indicating that one of said two conflicting features, included in said most frequently occurring feature set is of higher priority.

8. The system of claim 3 wherein the means for establishing the higher priority of two conflicting features comprises:
- a means for selecting a decision scheme based on the nature of said conflicting features, and
- a means for indicating the highest priority feature of said conflicting features based upon said selected decision scheme.

9. A programmable reproduction system having a means for increasing operator efficiency comprised of:
- a user interface capable of displaying programming parameters,
- means for selecting programming parameters during a programming mode,
- means for detecting mutually exclusive features that are selected by an operator during said programming mode, and
- means for resolving said mutually exclusive features during said programming mode, said resolving means automatically deselecting one of said mutually exclusive features prior to beginning execution of the copying operation, thereby eliminating additional keystrokes.

10. A programmable reproduction system having a means for increasing operator efficiency comprised of:
- a user interface capable of displaying programming parameters,
- a means for storing programmed feature sets of copying jobs to maintain a record of the frequency of selection of said job programming feature sets,
- a means for selection of programming parameters,
- a means for detection of conflicting or mutually exclusive features that are selected by an operator, and
- a means for resolution of said conflicting feature selections, which automatically deselects one of said mutually exclusive features based on said frequency of selection of job programming feature sets.

11. In a reproduction machine having a control and user interface with display for providing operator prompts and selectable features for programming the operation of the machine, the method of automatically recognizing a conflict of selected features and automatically resolving the conflict comprising the steps of:
- programming the machine by the selection of a first feature while the machine is in a programming mode,
- programming the machine by the selection of a second feature after the selection of the first feature while the machine is in the programming mode,
- recognizing the selection of the second feature to be in conflict with the first feature while the machine is still in the programming mode,
- responding to the recognition of the conflict to automatically resolve the conflict by deselecting either the first feature or the second feature in accordance with a predetermined decision scheme, while the machine is still in the programming mode and prior to beginning the copying operation.

12. The method of claim 11, including the step of altering the decision scheme.

13. In a reproduction machine having a control and user interface with display for programming the machine by selecting from a plurality of features, the method of automatically resolving conflicts in the selection of features comprising the steps of:

selecting a first feature while the machine is in a first feature selection mode, recognizing the absence of a programming conflict in selecting the first feature, executing a copying job in accordance with the features selected during said first feature selection mode, returning the machine to a second feature selection mode upon completion of the copying job, selecting a second feature while the machine is in the second feature selection mode, recognizing a programming conflict in selecting the second feature while the machine is in the second feature selection mode, and resolving the conflict by deselecting the first or the second feature while the machine is in the second feature selection mode.

14. The method of claim 13 wherein the step of resolving the conflict by deselecting the first or the second feature includes the step of automatically resolving the conflict in a logical sequence.

15. In a reproduction machine having a control and user interface with display for programming the machine by selecting from a plurality of features, the method of progressively resolving conflicts in the selection of features comprising the steps of:

selecting a first set of features, the first set of features having no programming conflict, selecting a second set of features, at least one of the second set of features being in conflict with any other feature of the first or second set of features, and resolving the conflict by automatically deselecting features in a logical sequence to provide a conflict free set of features, said set of features including at least one feature from each of the first and second set.

* * * * *